US007175315B2

(12) United States Patent
Eaton

(10) Patent No.: US 7,175,315 B2
(45) Date of Patent: Feb. 13, 2007

(54) FLUORESCENT LIGHT FIXTURE WITH A UNIQUELY-SHAPED REFLECTOR AND A MOTION SENSOR

(76) Inventor: William D. Eaton, 53 Hawthorne Rd., Essex Fells, NJ (US) 07021

( * ) Notice: Subject to any disclaimer, the term of this patent is extended or adjusted under 35 U.S.C. 154(b) by 0 days.

(21) Appl. No.: 10/913,758

(22) Filed: Aug. 7, 2004

(65) Prior Publication Data

US 2006/0028821 A1 Feb. 9, 2006

(51) Int. Cl.
*F21S 2/00* (2006.01)
*F21S 8/00* (2006.01)

(52) U.S. Cl. ..... 362/276; 362/275; 362/260; 362/394

(58) Field of Classification Search ..... 362/225, 362/276, 370, 389, 260, 221, 394
See application file for complete search history.

(56) References Cited

U.S. PATENT DOCUMENTS 4,587,600 A * 5/1986 Morten ..... 362/219
5,274,533 A 12/1993 Neary et al.
5,381,323 A * 1/1995 Osteen et al. ..... 362/276
5,473,522 A * 12/1995 Kriz et al. ..... 362/221
5,803,589 A * 9/1998 Lee ..... 362/225
6,007,220 A 12/1999 Wordin
6,092,913 A 7/2000 Edwards, Jr.
6,164,798 A 12/2000 Wordin
6,350,046 B1 * 2/2002 Lau ..... 362/364
6,428,183 B1 8/2002 McAlpin
6,781,129 B2 * 8/2004 Leen ..... 250/342
2001/0040805 A1 * 11/2001 Lansing et al. ..... 362/276
2004/0184264 A1 * 9/2004 Elam et al. ..... 362/148
2005/0073838 A1 * 4/2005 Haugaard et al. ..... 362/225

* cited by examiner

*Primary Examiner*—Sandra O'Shea
*Assistant Examiner*—Jacob Y. Choi
(74) *Attorney, Agent, or Firm*—Larry LiBerchuk

(57) ABSTRACT

A fluorescent light fixture comprises a substantially rectangular housing, a ballast located in the housing, a fluorescent lamp for emitting light in response to a first signal received from the ballast, a reflector made as a unitary structure for focusing the emitted light onto a pre-selected area, and a sensor for detecting an activity or inactivity, such that a second signal is transmitted to the ballast for triggering the first signal.

8 Claims, 6 Drawing Sheets

CATALOG NUMBER: 451-T5HO-4-UNV-MIRO4
LUMINAIRE: FORMED STEEL HOUSING, FORMED SPECULAR ALUMINUM REFLECTOR, NO ENCLOSURE.
LAMPS: FOUR SYLVANIA FP54/841/HO RATED AT 4400 LUMENS EACH.
BALLASTS: TWO ADVANCE ICN-2S54
MOUNTING: SURFACE
LUMEN TO CANDELA RATIO USED = 9.18
TOTAL INPUT WATTS = 234.4 AT 120.0 VOLTS
THE 0 DEGREE PLANE IS PARALLEL WITH THE LAMPS.

CANDELA DISTRIBUTION

| | 0.0 | 22.5 | 45.0 | 67.5 | 90.0 | FLUX |
|---|---|---|---|---|---|---|
| 0 | 2956 | 2956 | 2956 | 2956 | 2956 | |
| 5 | 2912 | 3013 | 3182 | 3283 | 3296 | 305 |
| 15 | 2783 | 3264 | 3679 | 3930 | 4047 | 1017 |
| 25 | 2565 | 3342 | 4151 | 4891 | 5161 | 1877 |
| 35 | 2259 | 3306 | 4752 | 5083 | 5223 | 2643 |
| 45 | 1860 | 3337 | 4397 | 4718 | 4731 | 3031 |
| 55 | 1420 | 3127 | 3627 | 3604 | 3689 | 2898 |
| 65 | 928 | 2373 | 2614 | 3008 | 3109 | 2457 |
| 75 | 477 | 1352 | 1749 | 1806 | 1798 | 1596 |
| | 73 | 435 | 495 | 521 | 544 | 506 |
| | 10 | 65 | 78 | 78 | 83 | |
| 95 | 0 | 13 | 13 | 0 | 0 | 11 |
| 105 | 0 | 16 | 10 | 0 | 0 | 8 |
| 115 | 0 | 0 | 0 | 0 | 0 | 1 |
| 125 | 0 | 0 | 0 | 0 | 0 | 0 |
| 135 | 0 | 0 | 0 | 0 | 0 | 0 |
| 145 | 0 | 0 | 0 | 0 | 0 | 0 |
| 155 | 0 | 0 | 0 | 0 | 0 | 0 |
| 165 | 0 | 0 | 0 | 0 | 0 | 0 |
| 175 | 0 | 0 | 0 | 0 | 0 | 0 |
| 180 | 0 | 0 | 0 | 0 | 0 | |

ZONAL LUMEN SUMMARY

| ZONE | LUMENS | %LAMP | %FIXT |
|---|---|---|---|
| 0- 30 | 3199 | 18.2 | 19.6 |
| 0- 40 | 5842 | 33.2 | 35.7 |
| 0- 60 | 11771 | 66.9 | 72.0 |
| 0- 90 | 16331 | 92.8 | 99.9 |
| 90- 120 | 21 | 0.1 | 0.1 |
| 90- 130 | 21 | 0.1 | 0.1 |
| 90- 150 | 21 | 0.1 | 0.1 |
| 90- 180 | 21 | 0.1 | 0.1 |
| 0- 180 | 16352 | 92.9 | 100.0 |

TOTAL LUMINAIRE EFFICIENCY: 92.9%

| | | |
|---|---|---|
| CIE TYPE: | DIRECT | |
| PLANE: | 0-DEG | 90-DEG |
| SPACING CRITERIA: | 1.2 | 2.1 |

FIG. 5A

FLUORESCENT LIGHT FIXTURE WITH A UNIQUELY-SHAPED REFLECTOR AND A MOTION SENSOR

BACKGROUND OF THE INVENTION

The present invention is related to light fixtures. More specifically, the present invention is related to a fluorescent light fixture having an all-aluminum housing for lightweight construction, a uniquely-shaped reflector for reflecting light in a downward direction for maximum intensity and for optimizing the light ray pattern to achieve high efficiency, and a motion sensor uniquely situated on the fixture.

Light fixtures with fluorescent lamps are widely used in commercial buildings, such as warehouses, manufacturing facilities, etc. These types of light fixtures, however, are also used in residential environment, such as kitchens, garages, etc. Optical and functional efficiency, among other things, contributes to the widespread use of such light fixtures in those aforementioned areas.

A fluorescent light fixture typically has an elongated housing for holding, among other things, a ballast, long tubular lamps, and a reflector. The ballast provides power to the lamps from the conventional AC source. The reflector is provided for concentrating and directing the emitted light in a downward direction.

As known to those skilled in the art, fluorescent lighting is advantageous in energy efficiency over incandescent lighting. According to some tests, fluorescent lights produce 50–100 lumens/watt compared to approximately 15 lumens/watt for incandescent bulbs.

Even though fluorescent lights are more efficient than incandescent bulbs, they are harder to control. The electrical discharge that excites the mercury vapor has to be started quickly and reliably, and then the current must be controlled from continuing to rise until it burns out the tube. The starting and control function is handled by a ballast.

SUMMARY OF THE INVENTION

It is an object of the present invention to provide a fluorescent light fixture, which is, among other things, lightweight and efficient.

The above and other objects are achieved by a fluorescent light fixture. According to one embodiment of the present invention, a fluorescent light fixture comprises a substantially rectangular housing, a ballast located in the housing, a fluorescent lamp for emitting light in response to a first signal received from the ballast, a reflector made as a unitary structure for focusing the emitted light onto a pre-selected area, and a sensor for detecting an activity or inactivity, such that a second signal is transmitted to the ballast for triggering the first signal.

BRIEF DESCRIPTION OF THE DRAWINGS

The present invention is illustrated in the figures of the accompanying drawings which are meant to be exemplary and not limiting, and in which like reference characters refer to like or corresponding parts:

FIGS. 5A, 5B and 5C are a set comprising various parts of a photometric test report for one embodiment of the light fixture according to the present invention.

DETAILED DESCRIPTION OF PREFERRED EMBODIMENTS

Figure 1:
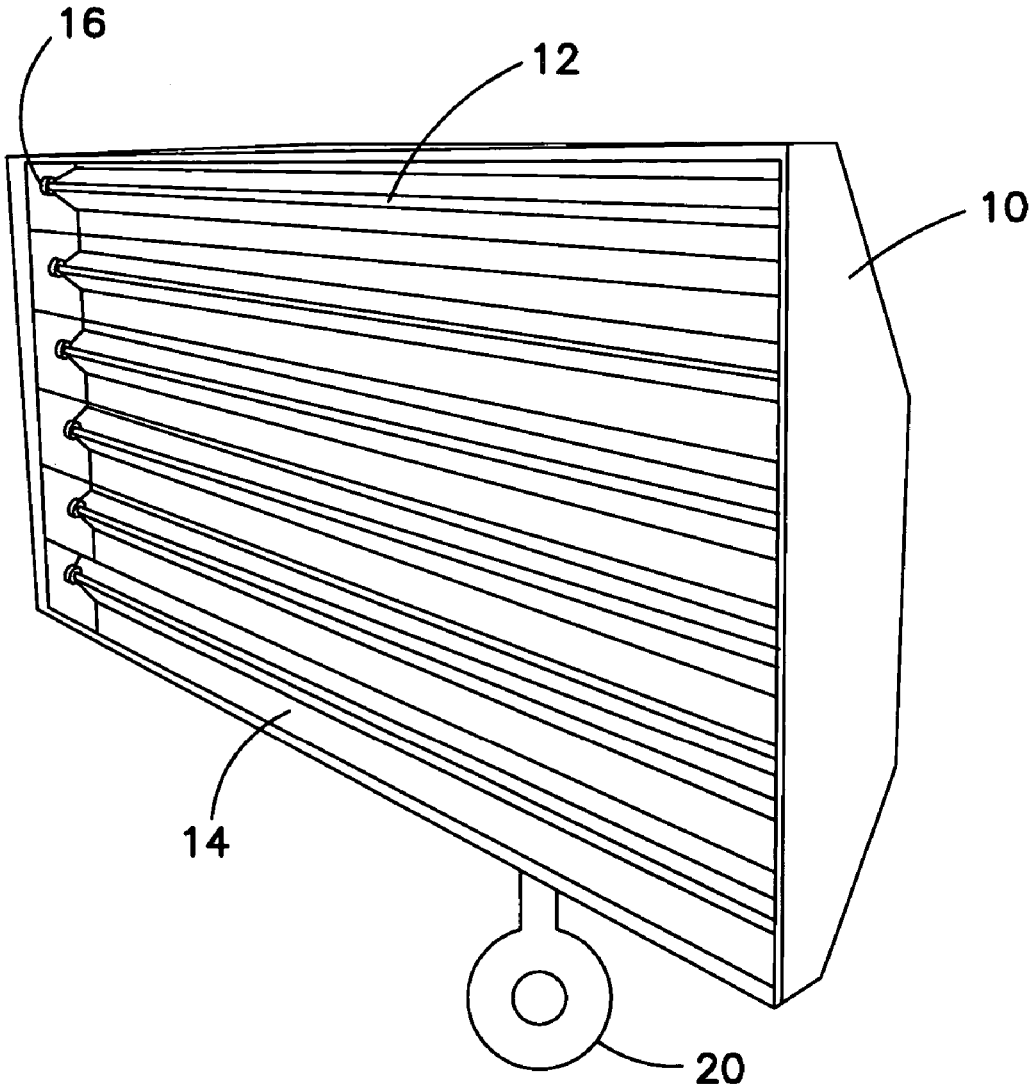
FIG. 1 shows one embodiment of the fluorescent light fixture in accordance with the present invention.

FIG. 1 displays one embodiment of the present invention, presenting a general overall structure of the inventive fluorescent light fixture according to this embodiment, as incorporated into a commercially successful product. As illustrated in this figure to provide a general overview of the inventive device, the fluorescent light fixture includes an elongated, substantially rectangular housing 10. Housing 10 supports reflector 14, which is not shown in this figure, but illustrated and fully described in detail hereinbelow. Shown in this figure are a number of long tubular fluorescent lamps 12 supported by reflector 14. In this particular embodiment, reflector 14 has capacity for six lamps. Lamps 12 are shown inserted into sockets 16, which are described and shown hereinbelow. Sockets 16 are electrically connected to wires 22 for carrying current from a power source to the lamps. As known to those skilled in the art, the lamp is a long narrow glass tube with two electrical connections on each of the metal caps. The caps seal the ends of the tube filled with such noble gases as argon, neon, etc. Mercury is also deposited into the tube. When AC power is supplied to the ballast, an electric discharge is established in the tube, which produces ultraviolet radiation. To produce light in the visible range, the inside wall of the tube is coated with phosphor. When the ultraviolet light strikes the inside wall, it produces excitations of the phosphor electrons and causes the phosphor coating to fluoresce with a bright glow.

Continuing with the general overall description of the embodiment of the present invention, housing 10 also includes ballast 18 (not shown in FIG. 1) for supplying power to the lamps 12. High-frequency electronic ballast 18 converts the power from the conventional AC source in order to provide high luminous efficiency, as known to those skilled in the art.

Housing 10 further comprises sensor 20. In one embodiment of the present invention, sensor 20 is a motion detector for detecting any motion or absence thereof within a pre-selected 2-dimensional area or 3-dimensional space. A signal is then sent to turn the light fixture on or off depending on the selected function and a predetermined period of time.

Figure 2:
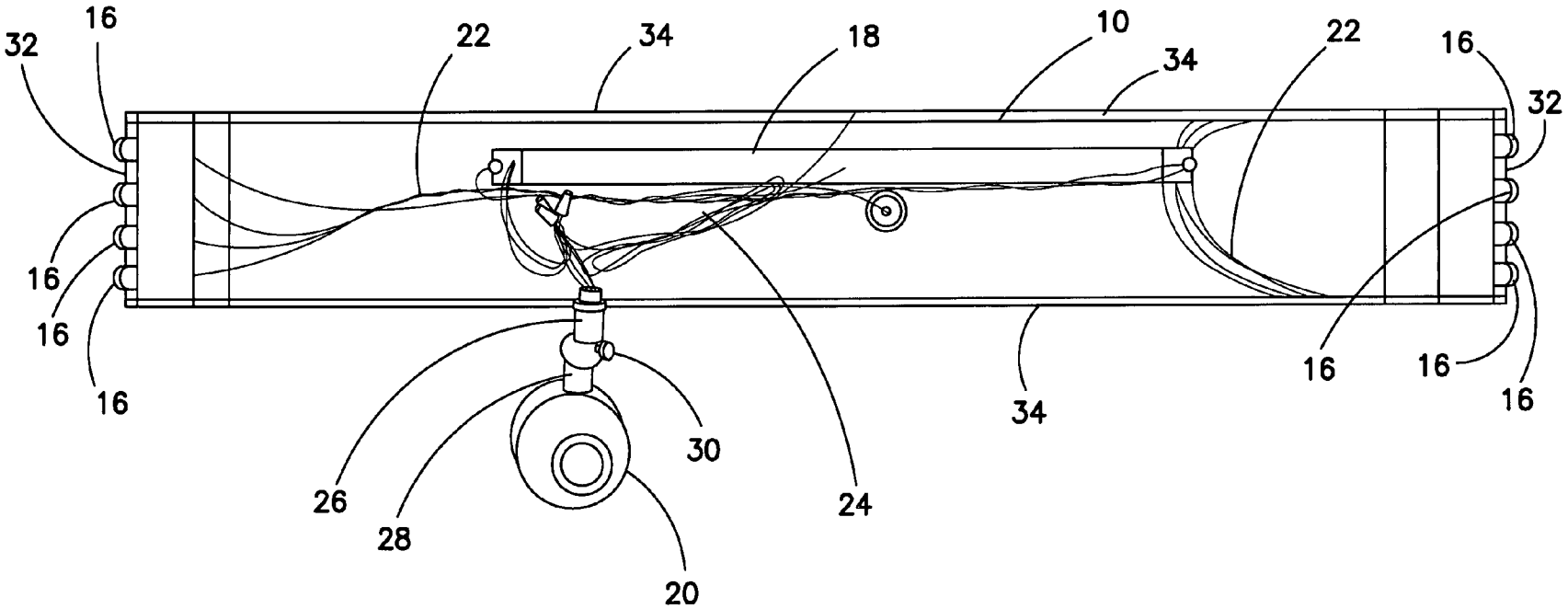
FIG. 2 shows in detail a housing for one embodiment of the fluorescent light fixture in accordance with the present invention.

FIG. 2 shows in more detail one embodiment of the fluorescent light fixture according to the present invention. Referring to FIG. 2, housing 10 comprises sockets 16 at both ends of the substantially rectangular structure. Wires 22 provide electrical connection between each socket 16 and ballast 18.

Also connected to ballast 18 is sensor 20 via wires 24, as shown in FIG. 2. In one embodiment of the present invention, sensor 20 detects any motion or absence thereof within a pre-selected 2-dimensional area or 3-dimensional space. If after a predetermined period of time and within the pre-selected area, the motion or absence thereof is detected by sensor 20, a signal is transmitted to ballast 18 via wires 24 to activate or de-activate the lamps. It will be appreciated that sensor 20 is attached to housing 10 via two stems 26 and 28. Connecting stems 26 and 28 is knob 30, which provides rotational movement of sensor 20 in 2 planes, vertical and horizontal. The sensor is thus adjustable in 2 planes for better detection. It will be further appreciated that sensor 20 is positioned slightly off-center with respect to a hypothetical axis running parallel to the shorter sides 32 of housing 10 and dividing housing 10 into two equally measured parts. Such location of sensor 20 on housing 10 allows the inventive light fixture to be placed on a ceiling in such a way as to avoid pipes, heavy-duty cables, railings and other obstructions, which might interfere with the positioned light fixture. It will be appreciated even further that housing 10 comprises additional alternative three locations 34, as shown in FIG. 2, which might be used to re-position and attach sensor 20, if needed or desired for getting around obstructions when mounting the light fixture. It will be appreciated still further that housing 10 is substantially an all-aluminum structure to provide lightweight and corrosion resistance to the inventive light fixture.

Figure 3:
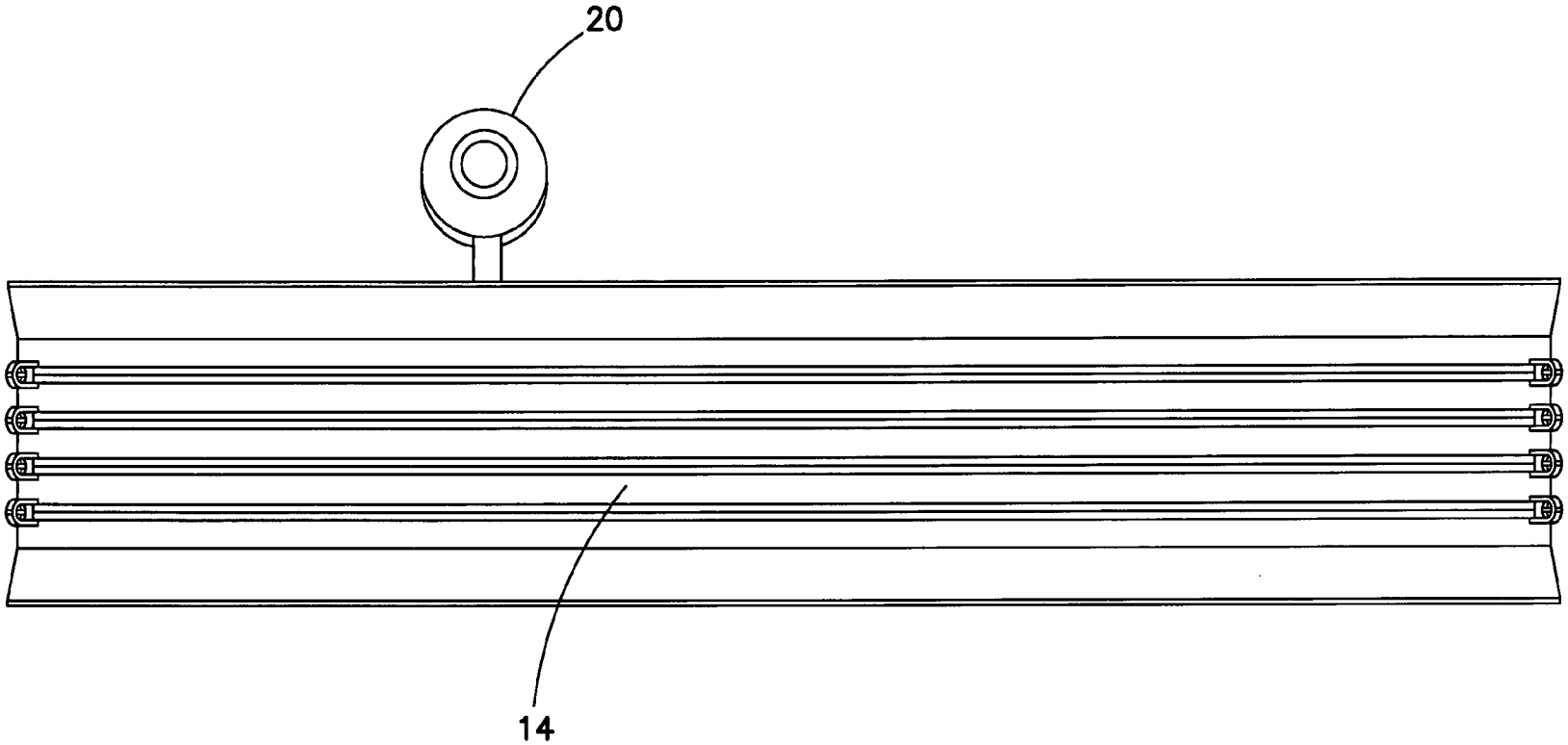
FIG. 3 shows in detail a reflector for one embodiment of the fluorescent light fixture in accordance with the present invention.

FIG. 3 illustrates in more detail a reflector in one embodiment of the fluorescent light fixture according to the present invention. In particular, reflector 14 is a single piece. Its unitary structure is made substantially entirely of aluminum. As the result, the inventive light fixture is lightweight and corrosion-free.

Figure 4:
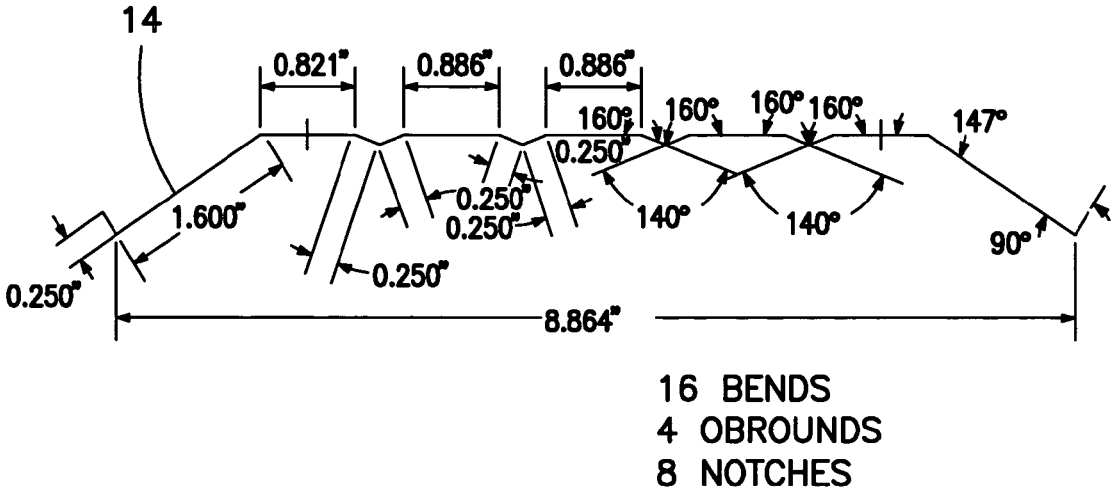
FIG. 4 shows dimensions of the reflector for one embodiment of the fluorescent light fixture in accordance with the present invention.

FIG. 4 shows representative dimensions of the reflector in one embodiment of the fluorescent light fixture according to the present invention. According to this embodiment of the present invention, reflector 14 includes four channels for fluorescent lamps. The configuration of reflector 14, as shown in FIG. 4, achieves optimization of the reflected light pattern and efficiency equal to or greater than 92%.

Figure 5B:
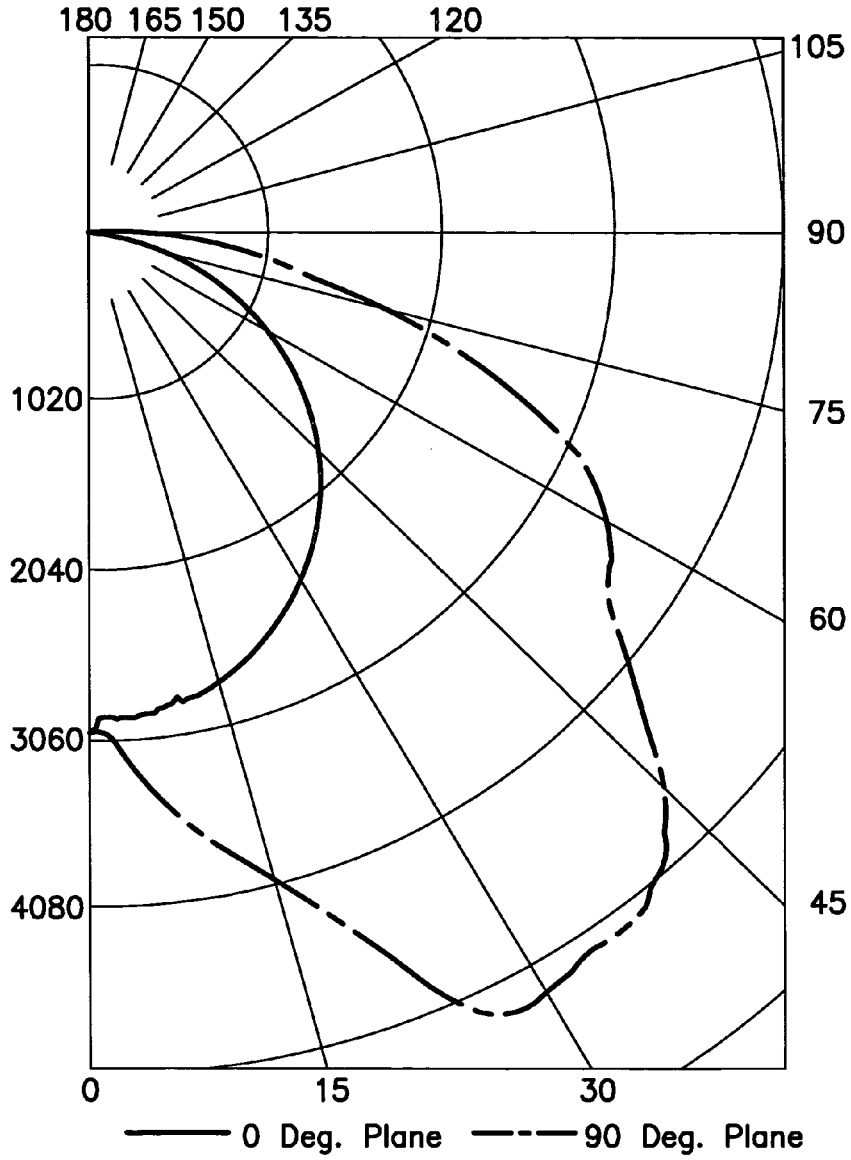
Figure 5C:
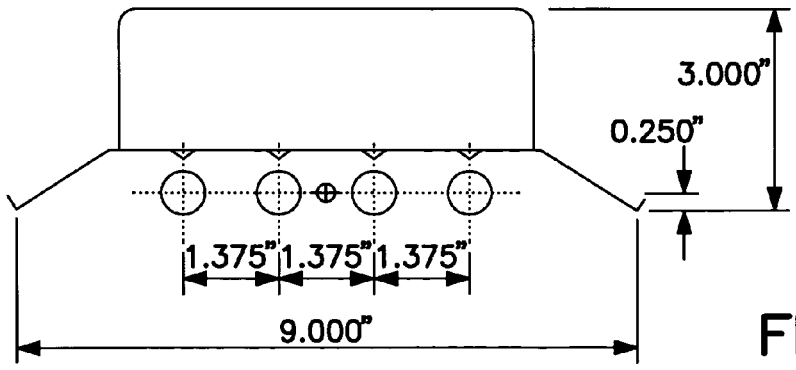

FIGS. 5A, 5B and 5C are a set comprising various parts of a photometric test report for one embodiment of the light fixture according to the present invention. The test was performed for the four-lamp fixture of the present invention.

The fluorescent light fixture according to the present invention is typically mounted on a ceiling. One of the inventive features of the present invention is transverse mounting. In particular, the inventive light fixture according to the present invention is mounted in such a way that its housing major axis is perpendicular to an isle in order to illuminate it, for example. This unique mounting provides better light concentration and focus than traditional mounting.

It is understood that sensor 20 in the fluorescent light fixture according to the present invention is not limited to motion detection and may be detecting other events, such as ambient light, etc.

It is further understood that the fluorescent light fixture according to the present invention is not limited to 4 lamps and may contain 1, 2, 3, 6 or 8 lamps.

It is still further understood that the fluorescent light fixture according to the present invention is not limited to one ballast and may comprise multiple ballasts.

While the invention has been described and illustrated in connection with preferred embodiments, many variations and modifications as will be evident to those skilled in this art may be made without departing from the spirit and scope of the invention, and the invention is thus not to be limited to the precise details of methodology or construction set forth above as such variations and modification are intended to be included within the scope of the invention.

What is claimed is:

1. A fluorescent light fixture, comprising:

a substantially rectangular housing;

a ballast located in said housing;

a plurality of fluorescent lamps for emitting light in response to a first signal received from said ballast;

a reflector made as an unitary structure for focusing the light emitted from the plurality of lamps onto a preselected area; and a sensor for detecting an activity or inactivity, such that a second signal is transmitted to said ballast for triggering said first signal, the sensor being adjustable in two planes for better detection, wherein a total luminaire efficiency of the fluorescent light fixture is between 92 and 93 percent.

2. The fluorescent light fixture according to claim 1, wherein said rectangular housing is substantially all aluminum.

3. The fluorescent light fixture according to claim 1, wherein said reflector is substantially all aluminum.

4. The fluorescent light fixture according to claim 1, wherein said sensor is a motion detector.

5. The fluorescent light fixture according to claim 1, wherein said sensor is an ambient light detector.

6. The fluorescent light fixture according to claim 1, wherein said sensor is positioned slightly off-center with respect to a hypothetical axis running parallel to two opposite shorter sides of said housing and dividing said housing into two substantially equally measured parts.

7. The fluorescent light fixture according to claim 1, wherein said housing comprises four alternate locations for positioning said sensor slightly off-center with respect to a hypothetical axis running parallel to two opposite shorter sides of said housing and dividing said housing into two substantially equally measured parts.

8. The fluorescent light fixture according to claim 1, wherein said fixture is adapted to be mounted transversely with respect to an isle.

* * * * *